US009591723B2

(12) United States Patent
Dahlen

(10) Patent No.: US 9,591,723 B2
(45) **Date of Patent: *Mar. 7, 2017**

(54) SYSTEMS AND METHODS FOR MANAGING LIGHTING SETTINGS IN A LIGHTING SYSTEM

(71) Applicant: KENALL MANUFACTURING COMPANY, Kenosha, WI (US)

(72) Inventor: Kevin Dahlen, Lindenhurst, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/072,011

(22) Filed: Mar. 16, 2016

(65) Prior Publication Data

US 2016/0198550 A1 Jul. 7, 2016

Related U.S. Application Data

(63) Continuation of application No. 14/559,427, filed on Dec. 3, 2014, now Pat. No. 9,320,117.

(51) Int. Cl.
*H05B 37/00* (2006.01)
*H05B 37/02* (2006.01)

(52) U.S. Cl.
CPC ..... *H05B 37/0245* (2013.01)

(58) Field of Classification Search
CPC ..... H05B 37/0245; H05B 33/0815; H05B 33/0818; H05B 41/295
USPC ..... 315/291, 307, 308, 312, 209 R, 246
See application file for complete search history.

(56) References Cited

U.S. PATENT DOCUMENTS 8,009,042 B2 * 8/2011 Steiner ..... H05B 37/0227 315/159
9,320,117 B1 * 4/2016 Dahlen ..... H05B 37/0245
2014/0001977 A1 * 1/2014 Zacharchuk ..... H04L 12/2816 315/291

OTHER PUBLICATIONS

Healthcare Lighting® Catalog, Healthcare Lighting®, Fairview, Pennsylvania, available before Dec. 3, 2014.

(Continued)

*Primary Examiner* — Minh D A
(74) *Attorney, Agent, or Firm* — Marshall, Gerstein & Borun LLP; Randall G. Rueth

(57) ABSTRACT

Embodiments are provided for systems and methods of managing a lighting system. According to certain aspects, the lighting system includes a low voltage controller (LVC) connected to multiple switches and to multiple drivers. Based on signals received from the switches, the LVC may determine a desired lighting setting as well as an adjustment setting of the lighting setting. The LVC may apply an appropriate signal to a driver to cause the driver to power a corresponding portion of luminaires. The LVC may include a memory configured to store adjustment settings so that the LVC may revert back to desired lighting and adjustment settings.

20 Claims, 4 Drawing Sheets

(56) References Cited

OTHER PUBLICATIONS

Hospital Lighting Controls and HVAC Strategies, Lighting Control & Design, Application Guide, Sep. 2010.
Room Controller—Semi-Private Patient Room w/Daylight Dimming and Pillow Speaker Integration product information, Cooper Controls, available before Dec. 3, 2014.
Trilume patient room recessed lighting product information, Healthcare Lighting®, available before Dec. 3, 2014.
Unity FAQs Fluorescent Models, downloaded from the Internet at: <http://www.visalighting.com/unity-faqs>, Visa Lighting, An Oldenburg Group Company, available before Dec. 3, 2014.

* cited by examiner

SYSTEMS AND METHODS FOR MANAGING LIGHTING SETTINGS IN A LIGHTING SYSTEM

CROSS-REFERENCE TO RELATED APPLICATIONS

This application is a continuation of U.S. patent application Ser. No. 14/559,427, filed Dec. 3, 2014, which is incorporated herein by reference in its entirety.

FIELD

This application generally relates to lighting systems. In particular, the application relates to platforms and techniques for managing a plurality of lighting settings in response to selections from various switches.

BACKGROUND

Most commercial buildings, parking structures, transportation areas or structures, and the like are equipped with lighting systems that typically include several luminaires or light fixtures configured to illuminate certain areas. The luminaires are powered by drivers that are physically wired to the luminaires. Different drivers may power different portions or sections of the luminaires, where the illuminated portions may be associated with different applications or environments.

In a hospital environment, for example, certain lighting settings may enhance the patient experience, while other lighting settings enable effective caregiver performance. In conventional lighting systems, patients in a hospital room may be provided with a remote switch that the patients may use to select certain lighting settings. For example, the patients may select to turn on reading lights in the hospital room. In certain circumstances, another individual such as a caregiver may override a patient setting for various reasons. However, the conventional systems do not revert back to a patient's desired setting after the override setting is deactivated. As a result, the patient must manually re-select a desired lighting setting.

Accordingly, there is an opportunity for more lighting systems and methods that enable efficient switching among various lighting settings with support for perpetual configurations.

SUMMARY

In am embodiment, a system for managing a plurality of lighting settings is provided. The system includes a remote switch for selecting a first lighting setting, a main switch electrically connected to the remote switch, the main switch for adjusting the first lighting setting and for selecting an override lighting setting, a first driver connected to a main power source and configured to power at least a first portion of a set of luminaires according to the first lighting setting, a second driver connected to the main power source and configured to power at least a second portion of the set of luminaires according to the override lighting setting, and a low voltage controller (LVC) electrically connected to the main switch, the remote switch via the main switch, the first driver, and the second driver. The LVC includes a memory and a processor, wherein the processor is configured to receive (i) an initial selection of the first lighting setting from the remote switch and (ii) an adjustment setting of the first lighting setting, wherein responsive to receiving the initial selection, the processor is configured to store, in the memory, the adjustment setting of the first lighting setting, and cause the first driver to power at least the first portion of the set of luminaires according to the first lighting setting and the adjustment setting. The processor is further configured to receive an override selection of the override lighting setting from the main switch and, responsive to receiving the override selection, cause the second driver to power at least the second portion of the set of luminaires according to the override lighting setting. The processor is further configured to receive a subsequent selection of the first lighting setting and, responsive to receiving the subsequent selection, retrieve, from the memory, the adjustment setting of the first lighting setting, and cause the first driver to power at least the first portion of the set of luminaires according to the first lighting setting and the adjustment setting.

In another embodiment, a method of managing a plurality of lighting settings associated with a set of luminaires powered by a first driver or a second driver, the plurality of lighting settings selectable by at least one of a remote switch and a main switch, is provided. The method includes receiving (i) an initial selection of a first lighting setting from the remote switch and (ii) an adjustment setting of the first lighting setting and, responsive to receiving the initial selection, storing, in a memory, the adjustment setting of the first lighting setting, and causing the first driver to power at least a first portion of the set of luminaires according to the first lighting setting and the adjustment setting. The method further includes receiving an override selection of an override lighting setting from the main switch and, responsive to receiving the override selection, causing the second driver to power at least a second portion of the set of luminaires according to the override lighting setting. The method further includes receiving a subsequent selection of the first lighting setting and, responsive to receiving the subsequent selection, retrieving, from the memory, the adjustment setting of the first lighting setting, and causing the first driver to power at least the first portion of the set of luminaires according to the first lighting setting and the adjustment setting.

In a further embodiment, a low voltage controller (LVC) configured to detect signals from a main switch and a remote switch, and electrically connected to a first driver and a second driver each configured to power respective portions of a set of luminaires, is provided. The LVC includes a memory adapted to store data, and a processor adapted to interface with the memory. The processor is configured to receive (i) an initial selection of the first lighting setting from the remote switch and (ii) an adjustment setting of the first lighting setting and, responsive to receiving the initial selection, cause the memory to store the adjustment setting of the first lighting setting, and cause the first driver to power at least a first portion of the set of luminaires according to the first lighting setting and the adjustment setting. The processor is further configured to receive an override selection of the override lighting setting from the main switch and, responsive to receiving the override selection, cause the second driver to power at least a second portion of the set of luminaires according to the override lighting setting. The processor is further configured to receive a subsequent selection of the first lighting setting and, responsive to receiving the subsequent selection, retrieve, from the memory, the adjustment setting of the first lighting setting, and cause the first driver to power at least the first portion of the set of luminaires according to the first lighting setting and the adjustment setting.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

The novel methods and systems disclosed herein generally relate to lighting systems and methods of facilitating various lighting settings or modes. In certain environments, certain lighting settings may be desirable over other lighting settings. For example, in a hospital, a patient may want to have reading lights activated during downtime, whereas a caregiver may need to have exam lights activated when performing an examination or check-up on the patient.

To accommodate multiple lighting settings, the lighting systems may be implemented with a set of luminaires along with multiple drivers each connected to a portion of the set of luminaires. A low voltage controller (LVC) may be connected to the drivers and may facilitate the operation of various lighting settings. Generally, each driver may be associated with a lighting setting and, accordingly, the LVC may cause the drivers to activate which initiates the corresponding lighting setting. The LVC may be connected to multiple switches. In one example implementation in a hospital environment, the LVC may be connected to a patient switch operable by a patient and a main switch operable by various individuals such as a caregiver. Each of the switches may be operable to cause the LVC to activate one or more of the lighting systems.

In implementations, the LVC may be configured with at least a processor and memory. The processor may facilitate control of the drivers and accordingly the various lighting settings. The memory is configured to store adjustment settings for the lighting settings. The adjustment settings may modify various aspects of the lighting settings, such as a dimming level of a given lighting setting. When the LVC receives a request to switch lighting settings from an initial lighting setting, the LVC is configured to store an adjustment setting of a current lighting setting and activate to the desired lighting setting. When the LVC receives a subsequent request to revert back to the initial lighting setting, the LVC retrieves the initial adjustment setting for the initial lighting setting from the memory, and activates the initial lighting setting according to the initial adjustment setting.

The systems and methods offer numerous improvements and benefits over existing implementations. First, by configuring the LVC with a memory, the LVC is able to store lighting setting information and revert back to desired levels during operation of the various lighting settings. In this regard, individuals need not have to re-adjust the adjustment settings when different lighting settings are initiated. Additionally, the systems and methods are implemented in such a way that the LVC may utilize 0-10 V lighting control to directly control luminaire activation and deactivation without the need for relays.

Figure 1:
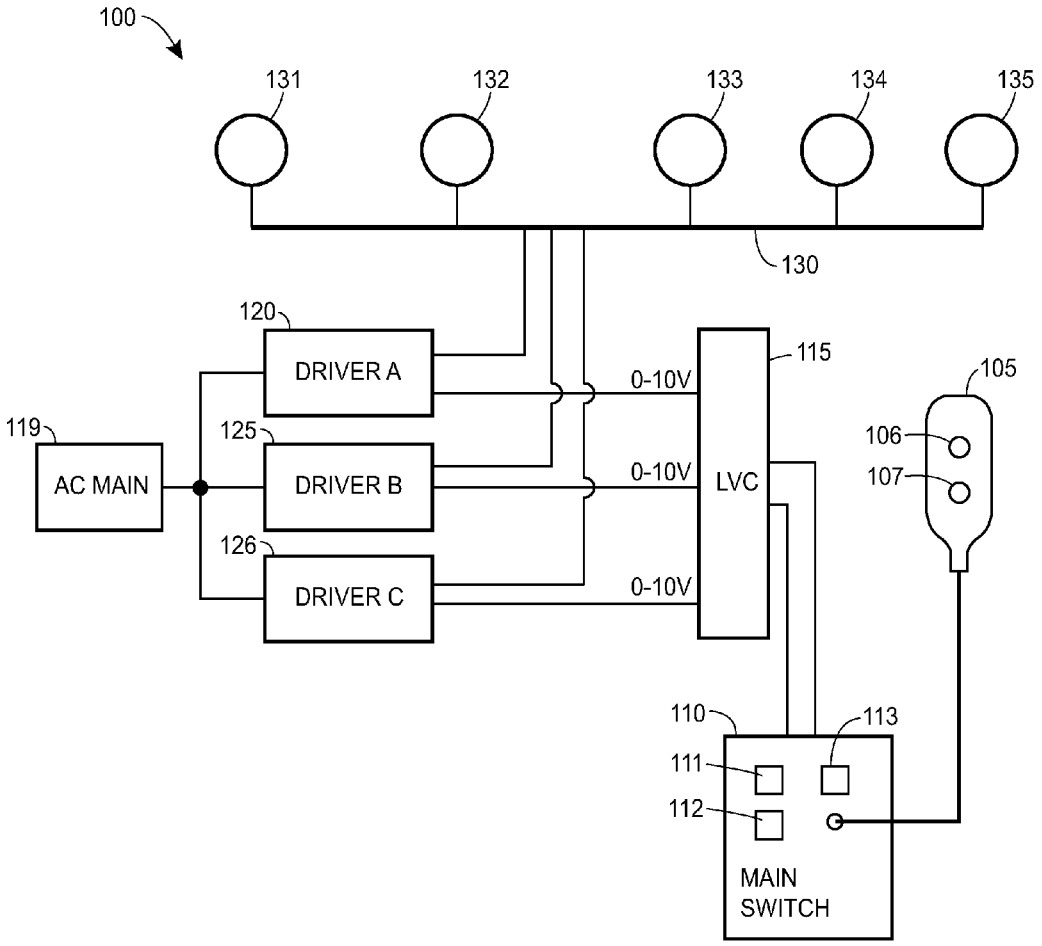
FIG. 1 is a diagram of an example lighting system in accordance with some embodiments.

Referring to FIG. 1, depicted is a lighting system 100 that may be implemented in various buildings, environments, and/or the like, according to the present embodiments. For purposes of explanation, the lighting system 100 may be implemented in a hospital or other type of patient-care facility, whereby the lighting system 100 may include luminaires in a room or space occupied by a patient or otherwise an individual receiving care. However, it should be appreciated that the lighting system 100 may be implemented in other environments. For example, the lighting system can be included in a parking garage (or a floor or section of the parking garage), commercial building (or a portion thereof), roadway, tunnel, or other transportation structure (or a portion thereof), residential home or building, or other indoor or outdoor space or environment.

As illustrated in FIG. 1, the lighting system 100 may include a main switch 110 connected to a remote switch 105. In embodiments, the remote switch 105 may be operable by an individual such as a patient, or may be operable automatically via sensor control or other types of control. Further, in embodiments, the main switch 110 may be disposed at an accessible location, such as on a wall, whereby the main switch 110 may also be operable by an individual such as a caregiver, or may be operable automatically via sensor control or other types of control. The main switch 110 and the remote switch 105 may be located within the same general location, area, room, or the like. For example, the main switch 110 and the remote switch 105 may be located in the same hospital room, whereby the main switch 110 may be located on a wall near the entrance and the remote switch 105 may be located near a patient bed.

The lighting system 100 further includes a low voltage controller (LVC) 115 electrically connected to the main switch 110 and to the remote switch 105 (via the main switch 110). The LVC 115 is also electrically connected to a set of drivers: driver A 120, driver B 125, and driver C 126. Although FIG. 1 illustrates three (3) drivers, it should be appreciated that other amounts of drivers are envisioned. Each of the drivers 120, 125, 126 is connected to an AC main power 119 and to at least a portion of a set of luminaires 130. It should be appreciated that the set of luminaires 130 can be various types such as, for example, fluorescent, incandescent, plasma, light-emitting diode (LED), or others.

Each of the drivers 120, 125, 126 can include various components configured to provide electric power, from the AC main power 119, to the corresponding portion of the set of luminaires 130. In particular, each of the drivers 120, 125, 126 may be hard-wired (e.g., via a set of wires or other conductors) to one or more of the set of luminaires 130 for conducting the electric power to the one or more of the set of luminaires 130. The portions of the set of luminaires 130 may be separate from each other or may overlap with each other. For example, driver A 120 may be connected to luminaires 131, 132, and 133; driver B 125 may be connected to luminaires 132, 133, and 134; and driver C 126 may be connected to luminaires 134 and 135.

The AC main power 119 may serve as the main power supply to each of the drivers 120, 125, 126. For example, the AC main power 119 may support a 120 V output voltage. Each of the drivers 120, 125, 126 may output various power levels, whereby the output power levels may generally be based on how many luminaires 130 (and types of the luminaires 130) to which the drivers 120, 125, 126 are respectively connected. For example, each of the drivers 120, 125, 126 may output power in a range of 20-500 Watts. However, it should be appreciated that other output voltages for the AC main power 119 and other output powers for the drivers 120, 125, 126 are envisioned.

Generally, at any given time, one of the drivers 120, 125, and 126 may be "active," whereby the LVC 115 controls which of the drivers 120, 125, 126 is active. In particular, the LVC 115 may output 0-10 V lighting control signals to the drivers 120, 125, 126. Each 0-10 V signal may be a DC voltage that varies between zero and ten volts. Responsive to the control signal, the corresponding driver 120, 125, 126 may scale its output so that at 10 V, the controlled luminaires should be at 100% of their potential output, and at 0 V the controlled luminaires should be at 0% output (i.e., "off"). For example, if the LVC 115 outputs a 5 V signal to driver B 125, then driver B 125 may scale its output to its corresponding portion of the set of luminaires 130 to 50%.

To facilitate control of the set of luminaires 130, the LVC 115 may be configured with various components. For example, the LVC 115 may include a processor configured to manage the control signals and a memory configured to store various settings. In operation, to send a signal to one of the drivers 120, 125, 126, the LVC 115 may detect corresponding low voltage momentary contact switches included on the remote switch 105 and the main switch 110. In particular, the remote switch 105 may include a set of switches, such as a remote switch A 106 and a remote switch B 107. Similarly, the main switch 110 may include a set of switches, such as a main switch A 111, a main switch B 112, and a main switch C 113. The switches 106, 107, 111, 112, 113 may be selectable by a user and may cause various lighting settings to be activated or deactivated. For example, the remote switch A 106 may be selected to activate a reading light setting, the main switch A 111 may be selected to activate an exam light setting, and the main switch B 112 may be selected to deactivate the reading light setting.

In operation, when one of the switches 106, 107, 111, 112, 113 is selected, the corresponding switch 105, 110 sends a signal to the LVC 115. A processor of the LVC 115 may process the signal to determine which lighting setting to activate. For example, if the switch A 106 is selected, then the LVC 115 determines to activate a reading light setting, which is controlled by driver A 120. In this example, the LVC may send a 0-10 V signal to driver A 120 which powers the corresponding portion of the set of luminaires 130 according to the signal.

The corresponding switches 106, 107, 111, 112, 113 also support adjustment settings for the lighting settings. In one particular implementation, the adjustment settings may specify a dimming level for a corresponding lighting setting. For example, the switch C 113 may enable an individual to adjust a dimming setting (e.g., 0%-100%) for the reading light setting selectable by the switch A 106. When the LVC 115 detects a selection of a lighting setting, the LFC 115 may also detect an adjustment setting corresponding to the lighting setting. For example, if the LVC 115 detects the reading light setting selectable by the switch A 106, the LVC 115 may also detect a dimming setting of 50% selectable by the switch C 113. Accordingly, the LVC 115 sends a 5V signal to driver A 120 to cause driver A 120 to power the corresponding portion of luminaires 130 at 50% power.

The configuration of the lighting system 100 offers additional improvements over existing lighting systems. In some existing lighting systems, an LVC utilizes a set of relays to control output power from a main power supply. In particular, the LVC sends a 0-10 V signal to a relay, which relays the signal to the main power supply, which powers on or powers off certain drivers accordingly. In contrast, the lighting system 100 may be configured without similar relays. The LVC 115 may therefore control the luminaires 130 by sending 0-10 V signals directly to a corresponding driver 120, 125, 126, which receive corresponding power from the AC main power 119. As a result, the LVC 115 may activate or deactivate an appropriate portion of the luminaires 130 by sending an appropriate 0-10 V signal to the appropriate driver 120, 125, 126.

Figure 2:
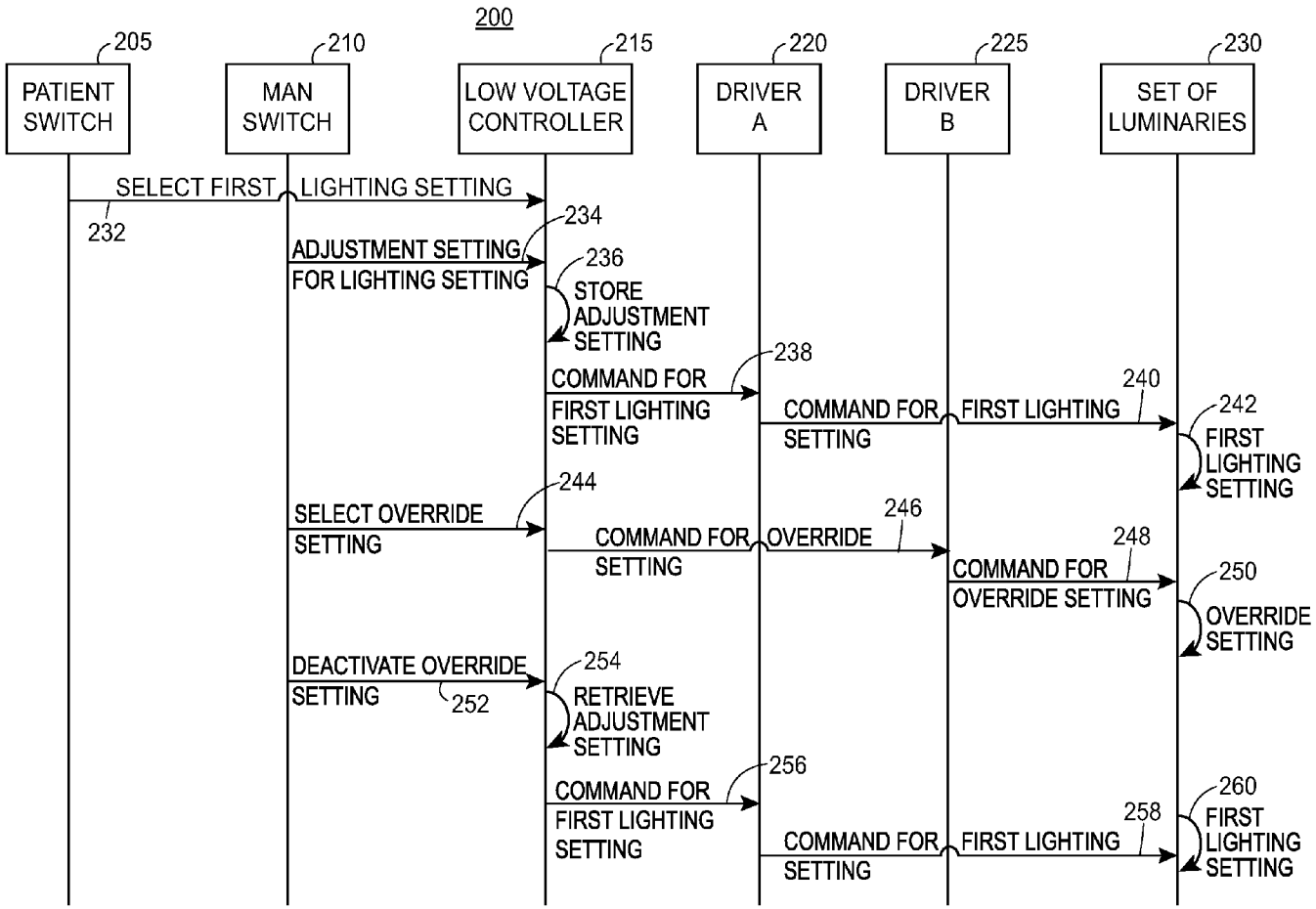
FIG. 2 is a signal diagram associated with facilitating control of lighting settings in a lighting system in according with some embodiments.

Referring to FIG. 2, depicted is an exemplary signal diagram 200 associated with facilitating various lighting settings in a lighting system. The signal diagram 200 includes a patient switch 205 (such as the remote switch 105 as described with respect to FIG. 1), a main switch 210 (such as the main switch 210 as described with respect to FIG. 1), a LVC 215 (such as the LVC 115 as described with respect to FIG. 1), a driver A 220 (such as the driver 120 as described with respect to FIG. 1), a driver B 225 (such as the driver 125 as described with respect to FIG. 1), and a set of luminaires 230 (such as the set of luminaires 130 as described with respect to FIG. 1). It should be appreciated that additional, fewer, or alternate components are envisioned.

The signal diagram 200 may begin with the patient switch 205 selecting (232) a first lighting setting. In particular, a patient operating the patient switch 205 may select the first lighting setting from various available settings (e.g., a reading light setting, an ambient lighting setting, etc.). The first lighting setting may correspond to a powering of a first portion of the set of luminaires 230, whereby driver A 220 is connected to the first portion of the set of luminaires 230. In some embodiments, the patient may also select, via the patient switch 205, an adjustment setting for the first lighting setting. In other embodiments, an individual (e.g., a caregiver) may use the main switch 210 to select (234) an adjustment setting for the first lighting setting, whereby the main switch 210 sends the adjustment setting to the LVC 215. The adjustment setting may modify the first lighting setting in a variety of ways. For example, the adjustment setting may specify a dimming level of the first lighting setting.

The LVC 215 may store (236) the adjustment setting in memory for later access or retrieval. The LVC 215 may also send (238) a command to driver A 220 to initiate or activate the first lighting setting according to the adjustment setting. In particular, the LVC 215 may send a 0-10 V control signal to driver A 220, whereby the 0-10 V control signal specifies the adjustment setting (e.g., 6 V for 40% dimmed, 5 V for 50% dimmed, etc.). Driver A 220 may be electrically connected to the first portion of the set of luminaires 230. Accordingly, driver A 220 may provide (240) electrical power to the first portion of the set of luminaires 230 based on the received control signal. Driver A 220 may provide the electrical power from a main AC power source. The set of luminaires 230 may accordingly initiate (242) the first lighting setting by illuminating the first portion of the set of luminaires 230 using the received power. The first lighting setting may also be initiated according to the adjustment setting specified by the main switch 210 (or in some implementations, the patient switch 205). For example, if the first lighting setting corresponds to a reading light setting and the adjustment setting specifies 70% dimming, then the set of luminaires 230 may activate the corresponding reading lights at 70% dimming.

Subsequent to the first lighting setting being activated/initiated, an individual may select to initiate an additional lighting setting that may operate to override the first lighting setting. As depicted in FIG. 2, an individual (e.g., a caregiver) may access the main switch 210 to select (244) an override setting that is communicated to the LVC 215. In embodiments, the override setting is designed to override the first lighting setting selected via the patient switch 205. For example, a caregiver may select an exam setting in advance of a procedure on or examination of the patient, whereby the exam setting may override an ambient light setting selected by the patient. The override setting may correspond to a second portion of the set of luminaires 230, whereby driver B 225 is connected to the second portion of the set of luminaires 230. In embodiments, the first portion of the set of luminaires 230 and the second portion of the set of luminaries 230 may be separate, or may partially overlap.

The LVC controller 215 may send (246) a command to driver B 225 to initiate the override setting. In particular, the LVC 215 may send a 0-10 V control signal to driver B 225, whereby the 0-10 V control signal specifies the adjustment setting (e.g., 6 V for 40% dimmed, 5 V for 50% dimmed, etc.). Driver B 225 may be electrically connected to the second portion of the set of luminaires 230. Accordingly, driver B 225 may provide (248) electrical power to the second portion of the set of luminaires 230 based on the received control signal. Driver B 225 may provide the electrical power from a main AC power source. The set of luminaires 230 may accordingly initiate (250) the override setting by illuminating the second portion of the set of luminaires 230 using the received power. For example, if the override setting corresponds to an exam light setting, then the second portion of the set of luminaires 230 may be a set of exam luminaires.

The override setting may, at some point, be deactivated. For example, if the override setting is an exam lighting setting and a caregiver has finished a patient exam, then the exam lighting setting may no longer be needed. In one implementation, the patient switch 205 may enable a patient to deactivate the override setting through a selection. In another implementation, an individual may use the main switch 210 to deactivate (252) the override setting. Instead of reverting back to a default setting with default adjustments (e.g., a set of reading luminaires at full brightness), the LVC 215 is able to re-initiate the first lighting setting according to the patient's desired adjustment settings. In particular, the LVC 215 may retrieve (254) the original adjustment setting from the memory of the LVC 215.

The LVC 215 may then send (256) a command to driver A 220 to re-initiate the first lighting setting according to the adjustment setting. In particular, the LVC 215 may send a 0-10 V control signal to driver A 220, whereby the 0-10 V control signal specifies the adjustment setting (e.g., 6 V for 40% dimmed, 5 V for 50% dimmed, etc.). As described above, driver A 220 may be electrically connected to the first portion of the set of luminaires 230. Accordingly, driver A 220 may provide (258) electrical power to the first portion of the set of luminaires 230 based on the received control signal. Driver A 220 may provide the electrical power from a main AC power source. The set of luminaires 230 may accordingly initiate (260) the first lighting setting by illuminating the first portion of the set of luminaires 230. The first lighting setting may also be initiated according to the adjustment setting retrieved in (254). For example, if the first lighting setting corresponds to a reading light setting and the adjustment setting specifies 70% dimming, then the set of luminaires 230 may activate the corresponding reading lights at 70% dimming.

Figure 3:
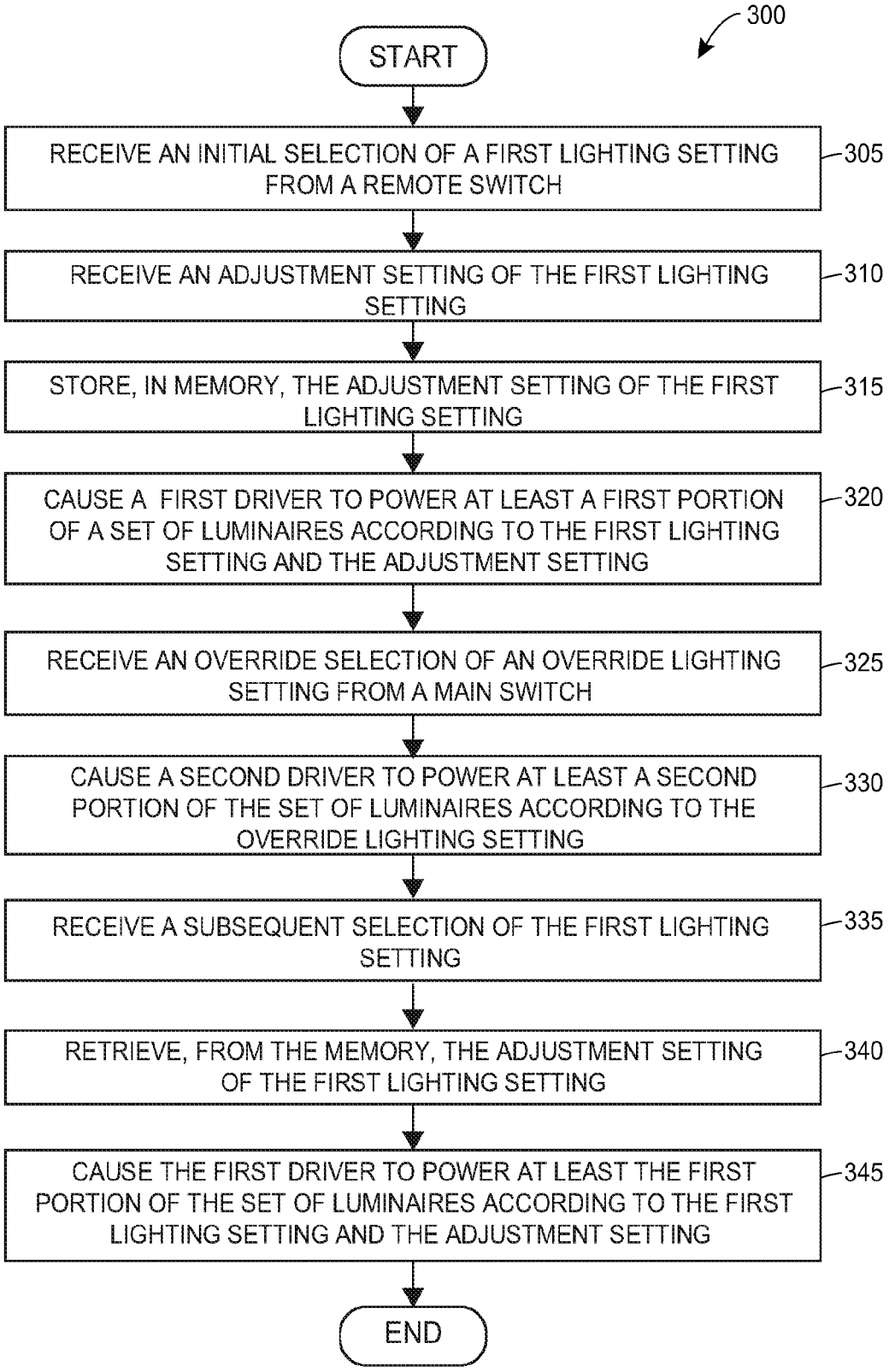
FIG. 3 is a flow diagram associated with facilitating control of lighting settings in a lighting system, in accordance with some embodiments.

FIG. 3 is a flowchart of a method 300 for managing a plurality of lighting settings associated with a set of luminaires. According to embodiments, at any particular time, the set of luminaires may be powered by a first driver or a second driver, and the plurality of lighting settings may be selectable by at least one of a remote switch and a main switch. As described, the method 300 may be facilitated by a LVC (such as the LVC 115 described with respect to FIG. 1). However, it should be appreciated that other components or combinations of components may facilitate the method 300.

The method 300 begins with the LVC receiving (block 305) an initial selection of a first lighting setting from the remote switch. In some implementations, the remote switch may enable a user (e.g., a patient) to make the initial selection, where the remote switch sends the initial selection to the main switch, and where the main switch may relay the initial selection to the LVC. In another implementation, the LVC may receive the initial selection directly from the remote switch. The LVC may also receive (block 310) an adjustment setting of the first lighting setting. The adjustment setting specifies to a specific parameter (e.g., dimming level) for the first lighting setting. The adjustment setting may be specified via the remote switch, or may be specified via the main switch.

The LVC may store (block 315), in memory, the adjustment setting of the first lighting setting for later access and retrieval. The LVC may also cause (block 320) a first driver to electrically power at least a first portion of a set of luminaires according to the first lighting setting and the adjustment setting. In implementations, the first driver may be electrically connected to the first portion of the set of luminaires, and the LVC may send a 0-10 V signal to the first driver to cause the first driver to electrically power the first portion of the set of luminaires.

Subsequent to causing the first driver to electrically power the first portion of the set of luminaires, the LVC may receive (block 325) an override selection of an override lighting setting from a main switch. In embodiments, the override lighting setting is configured to override the current lighting setting (here: the first lighting setting). Accordingly, the LVC may cause (block 330) a second driver to electrically power at least a second portion of the set of luminaires according to the override lighting setting. In implementations, the second driver may be electrically connected to the second portion of the set of luminaires, and the LVC may send a 0-10 V signal to the second driver to cause the second driver to electrically power the second portion of the set of luminaires.

Subsequent to causing the second driver to power the second portion of the set of luminaires, the LVC may receive (block 335) a subsequent selection of the first lighting setting. In some cases, the override selection may be deselected via the main switch. In other cases, the first lighting setting may be re-selected via the main switch. In further cases, the first lighting setting may be selected via the remote switch. In response to receiving the subsequent selection, the LVC may retrieve (block 340), from memory, the adjustment setting of the first lighting setting that was stored in block 315. The LVC may then cause (block 345) the first driver to electrically power at least the first portion of the set of luminaires according to the first lighting setting and the adjustment setting. Accordingly, the LVC may revert the lighting system back to the first lighting setting at the adjustment setting desired by the patient (and without reverting to a default adjustment setting). Thus, the patient need not re-specify the adjustment setting.

Figure 4:
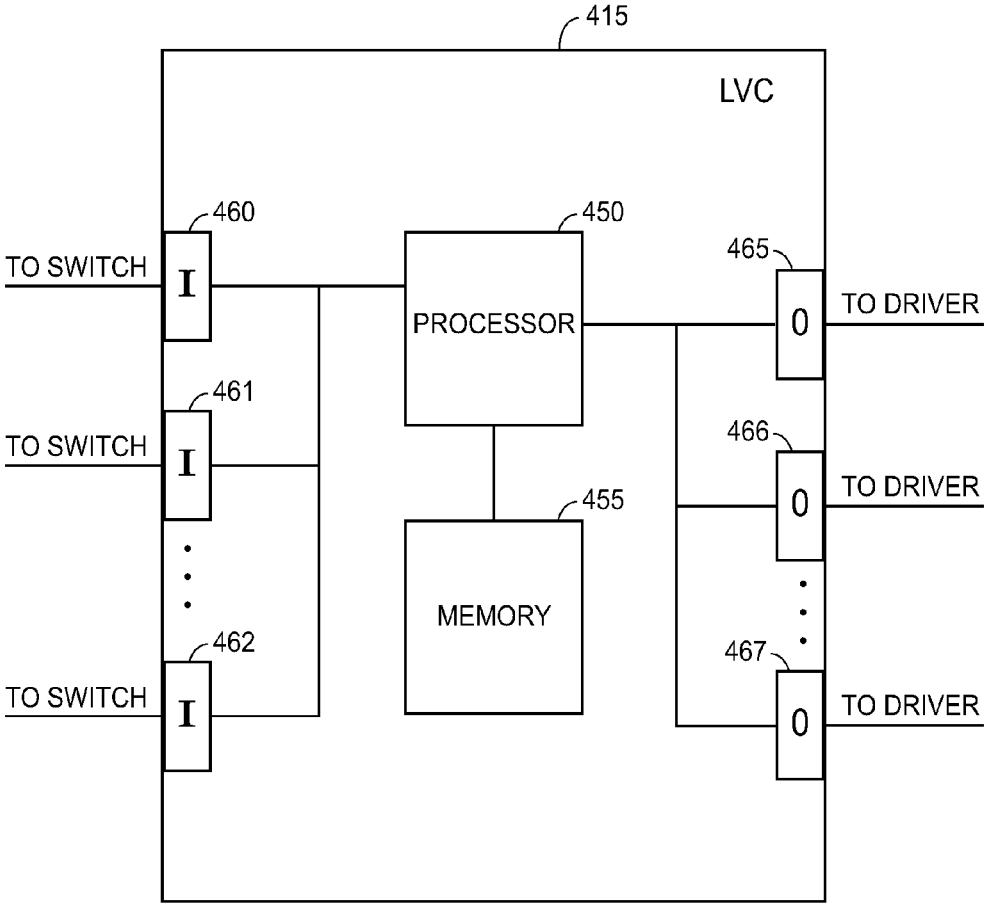
FIG. 4 is a schematic diagram of an example low voltage controller (LVC), in accordance with some embodiments.

FIG. 4 illustrates an example LVC 415 according to the present embodiments. The LVC 415 may be the same as or similar to the LVC 115 as discussed with respect to FIG. 1. It should be appreciated that the LVC 415 is merely an example, and may include additional, fewer, or alternate components.

The LVC 415 includes a processor 450 and a memory 455. The processor 450 may connect to a set of inputs 460, 461, 462. Although FIG. 4 depicts three (3) inputs, it should be appreciated that other amounts of inputs are envisioned. Each of the inputs 460, 461, 462 may be electrically connected to one or more switches, such as the remote switch 105 and/or main switch 110 as discussed with respect to FIG. 1.

In operation, the processor 450 may receive signals from the set of inputs 460, 461, 462, whereby the signals specify various lighting settings. Further, the signals from the set of inputs 460, 461, 462 may include adjustment settings for the lighting settings. The processor 450 may process the signals from the set of inputs 460, 461, 462 according to either an individual mode where the set of inputs 460, 461, 462 individually dictate a lighting setting (and a corresponding load), or a sequential mode where the set of inputs 460, 461, 462 allows control of two lighting settings (and two corresponding loads) with one common input and control of an additional lighting setting with another input.

The memory 455 may include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others. The processor 450 may cause the memory 455 to store adjustment settings for the lighting settings, whereby the processor 450 may access the stored adjustment settings from the memory 455.

The processor 450 may further connect to a set of outputs 465, 466, 467. Although FIG. 4 depicts three (3) outputs, it should be appreciated that other amounts of outputs are envisioned. Each of the outputs 465, 466, 467 may be associated with a load and may be connected to a driver. In operation, the processor 450 determines an appropriate lighting setting and corresponding adjustment setting from the input signals, and may send corresponding 0-10 V signals to one or more of the outputs 465, 466, 467 and to the corresponding driver. Accordingly, the corresponding driver may supply power to the corresponding portion of luminaires via an AC main power supply, as discussed herein.

Thus, it should be clear from the preceding disclosure that the systems and methods offer improved lighting systems. The embodiments advantageously enable efficient and effective control of multiple lighting settings in a lighting system, and providing support for perpetual adjustment setting storage.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

The invention claimed is:

1. A system for managing a plurality of lighting settings, comprising:

a remote switch for selecting a first lighting setting;

a main switch electrically connected to the remote switch, the main switch for adjusting the first lighting setting and for selecting an override lighting setting;

a first driver connected to a main power source and configured to power at least a first portion of a set of luminaires according to the first lighting setting;

a second driver connected to the main power source and configured to power at least a second portion of the set of luminaires according to the override lighting setting; and a low voltage controller (LVC) electrically connected to the main switch, the remote switch via the main switch, the first driver, and the second driver, the LVC including a processor, wherein the processor is configured to:

receive an initial selection of the first lighting setting from the remote switch, responsive to receiving the initial selection:

cause the first driver to power at least the first portion of the set of luminaires according to the first lighting setting, receive an override selection of the override lighting setting from the main switch, responsive to receiving the override selection, cause the second driver to power at least the second portion of the set of luminaires according to the override lighting setting, receive a subsequent selection of the first lighting setting, and responsive to receiving the subsequent selection:

cause the first driver to power at least the first portion of the set of luminaires according to the first lighting setting.

2. The system of claim 1, wherein the low voltage controller (LVC) further includes a memory, and wherein the processor is further configured to:

receive an adjustment setting of the first lighting setting, and responsive to receiving the initial selection:

store, in the memory, the adjustment setting of the first lighting setting, and cause the first driver to power at least the first portion of the set of luminaires according to the first lighting setting and the adjustment setting.

3. The system of claim 2, wherein responsive to receiving the subsequent selection, the processor is further configured to:

retrieve, from the memory, the adjustment setting of the first lighting setting, and cause the first driver to power at least the first portion of the set of luminaires according to the first lighting setting and the adjustment setting.

4. The system of claim 2, wherein the low voltage controller (LVC) receives the adjustment setting from the main switch.

5. The system of claim 2, wherein the low voltage controller (LVC) receives the adjustment setting from the remote switch via the main switch.

6. The system of claim 1, wherein at least a portion of the first portion of the set of luminaires overlaps with the second portion of the set of luminaires.

7. The system of claim 1, wherein the first portion of the set of luminaires is separate from the second portion of the set of luminaires.

8. A method of managing a plurality of lighting settings associated with a set of luminaires powered by a first driver or a second driver, the plurality of lighting settings selectable by at least one of a remote switch and a main switch, the method comprising:

receiving an initial selection of a first lighting setting from the remote switch;

responsive to receiving the initial selection:

causing the first driver to power at least a first portion of the set of luminaires according to the first lighting setting;

receiving an override selection of an override lighting setting from the main switch;

responsive to receiving the override selection, causing the second driver to power at least a second portion of the set of luminaires according to the override lighting setting;

receiving a subsequent selection of the first lighting setting; and responsive to receiving the subsequent selection:

causing the first driver to power at least the first portion of the set of luminaires according to the first lighting setting.

9. The method of claim 8, further comprising:

receive an adjustment setting of the first lighting setting; and wherein responsive to receiving the initial selection, the method further comprises:

storing, in a memory, the adjustment setting of the first lighting setting, and causing the first driver to power at least the first portion of the set of luminaires according to the first lighting setting and the adjustment setting.

10. The method of claim 9, wherein responsive to receiving the subsequent selection, the method further comprises:

retrieving, from the memory, the adjustment setting of the first lighting setting, and causing the first driver to power at least the first portion of the set of luminaires according to the first lighting setting and the adjustment setting.

11. The method of claim 9, wherein receiving the adjustment setting of the first lighting setting comprises:

receiving the adjustment setting from the main switch.

12. The method of claim 9, wherein receiving the adjustment setting of the first lighting setting comprises:

receiving the adjustment setting from the remote switch via the main switch.

13. The method of claim 8, wherein at least a portion of the first portion of the set of luminaires overlaps with the second portion of the set of luminaires.

14. The method of claim 8, wherein the first portion of the set of luminaires is separate from the second portion of the set of luminaires.

15. A low voltage controller (LVC) configured to detect signals from a main switch and a remote switch, and electrically connected to a first driver and a second driver each configured to power respective portions of a set of luminaires, the LVC comprising:

a processor configured to:

receive an initial selection of the first lighting setting from the remote switch, responsive to receiving the initial selection:

cause the first driver to power at least a first portion of the set of luminaires according to the first lighting setting, receive an override selection of the override lighting setting from the main switch, responsive to receiving the override selection, cause the second driver to power at least a second portion of the set of luminaires according to the override lighting setting, receive a subsequent selection of the first lighting setting, and responsive to receiving the subsequent selection:

cause the first driver to power at least the first portion of the set of luminaires according to the first lighting setting.

16. The low voltage controller (LVC) of claim 15, further comprising:

a memory adapted to store data;

and wherein the processor is further configured to:

receive an adjustment setting of the first lighting setting, and responsive to receiving the initial selection:

cause the memory to store the adjustment setting of the first lighting setting, and cause the first driver to power at least the first portion of the set of luminaires according to the first lighting setting and the adjustment setting.

17. The low voltage controller (LVC) of claim 16, wherein responsive to receiving the subsequent selection, the processor is further configured to:

retrieve, from the memory, the adjustment setting of the first lighting setting, and cause the first driver to power at least the first portion of the set of luminaires according to the first lighting setting and the adjustment setting.

18. The low voltage controller (LVC) of claim 15, wherein the processor receives the adjustment setting from the main switch.

19. The low voltage controller (LVC) of claim 15, wherein the processor receives the adjustment setting from the remote switch via the main switch.

20. The low voltage controller (LVC) of claim 15, wherein at least a portion of the first portion of the set of luminaires overlaps with the second portion of the set of luminaires.

* * * * *